US006394012B1

(12) United States Patent
French et al.

(10) Patent No.: US 6,394,012 B1
(45) Date of Patent: May 28, 2002

(54) FABRIC FRAME HOLDER FOR EMBROIDERY

(76) Inventors: Nick L. French, 571 Watson Rd., Erlanger, KY (US) 41018; Mark E. Mason, 6286 Lesourdsville Westchester Rd., Hamilton, OH (US) 45011; Vytenis J. Viltrakis, 1027 Highland Ave., Ft. Thomas, KY (US) 41075

( * ) Notice: Subject to any disclaimer, the term of this patent is extended or adjusted under 35 U.S.C. 154(b) by 0 days.

(21) Appl. No.: 09/872,946

(22) Filed: Jun. 1, 2001

Related U.S. Application Data

(63) Continuation-in-part of application No. 09/854,275, filed on May 11, 2001.

(51) Int. Cl.[7] ..... D05C 9/04
(52) U.S. Cl. ..... 112/103
(58) Field of Search ..... 112/103, 470.14, 112/475.11

(56) References Cited

U.S. PATENT DOCUMENTS

| | | | | |
|---|---|---|---|---|
| 3,664,288 A | | 5/1972 | Von Boden et al. | 112/103 |
| 4,598,488 A | | 7/1986 | Inteso | 38/102.3 |
| 4,981,092 A | | 1/1991 | Bauman et al. | 112/103 |
| 4,993,333 A | | 2/1991 | Moore, III | 112/103 |
| 5,000,103 A | | 3/1991 | Beermann | 112/121.12 |
| 5,005,501 A | | 4/1991 | Kita | 112/121.12 |
| 5,101,746 A | | 4/1992 | Frye | 112/121.12 |
| 5,237,941 A | | 8/1993 | Kraft et al. | 112/103 |
| 5,261,338 A | | 11/1993 | Tajima et al. | 112/103 |
| 5,546,877 A | | 8/1996 | Moore | 112/103 |
| 5,590,613 A | | 1/1997 | Head | 112/103 |
| 5,651,325 A | | 7/1997 | Conley, Jr. | 112/470.14 |
| 5,664,350 A | | 9/1997 | Moore, III | 38/102.2 |
| 5,915,315 A | | 6/1999 | Bentz | 112/103 |
| 5,937,774 A | * | 8/1999 | Hayashi | 112/103 |
| 6,109,194 A | | 8/2000 | Farb | 112/103 |
| 6,152,056 A | | 11/2000 | Ulerich et al. | 112/103 |
| 6,227,129 B1 | * | 5/2001 | Parker, Jr. | 112/475.18 |
| 6,240,863 B1 | * | 6/2001 | Vickroy et al. | 112/475.18 |

OTHER PUBLICATIONS

Copy of Internet advertisement of Tajima West; Oct. 21, 1998; pp. 1–3.

Copy of Internet advertisement of Hirsch Embroidery Accessories; date unknown but believed to be prior art; 3 pages.

* cited by examiner

*Primary Examiner*—Ismael Izaguirre
(74) *Attorney, Agent, or Firm*—Womble Carlyle Sandridge & Rice, PLLC

(57) ABSTRACT

A fabric frame holder for holding a fabric to be embroidered using automated embroidery equipment having a body portion, multiple sets of adaptor plates, and a multiple fabric mounting frames. The body portion has a central area for releasably receiving the fabric mounting frames, and a pair of attachment arms extending laterally to either side. The attachment arms terminate in attachment ends at which points one set of the adaptor plates, which correspond to the type of embroidery machine being utilized, are attached, and a selected fabric holding frames is mounted to the central body portion.

11 Claims, 7 Drawing Sheets

FABRIC FRAME HOLDER FOR EMBROIDERY

RELATED APPLICATIONS

This application is a continuation-in-part of application Ser. No. 09/854,275, filed on May 11, 2001, the content of which is incorporated herein by reference in its entirety.

FIELD OF THE INVENTION

The present invention relates to the field of embroidery operations, and, more particularly, to a fabric holding device adaptable to different makes of embroidery machines and having interchangeable mounting frames.

BACKGROUND OF THE INVENTION

In the sewing and embroidery industry, fabric holding clamps, templates, and hoops are widely used for holding individual work pieces on single and multi-head embroidery machines. These devices are numerous, due in part to the number of different manufacturers and models of automated embroidery machines on the market and in use. For example, Tajima, Melco, Barudan, SWF, Brother, and Toyota each produce such machines. While certain features are similar, such as the general manner in which embroidery fabric pieces are held for the embroidery operation, each type of machine is neither designed nor constructed to accept the fabric frame holder from other manufacturers. This means that an embroidery operation at the present time must limit itself to machines from a single manufacturer, or must purchase multiple fabric frame holders of the same size and type for each of the different models in use. Most operations choose the latter course of action for economic reasons. As a result, the embroidery company must carry different fabric frame holders for each different make of machine.

An additional problem in the sewing industry associated with fabric frame holders is that the conventional method of holding a fabric relative to the needle of an automatic sewing machine involves the use of a two-piece hoop assembly which secures the fabric between an inner hoop ring and an outer hoop ring. Typically, the two-piece hoop and the fabric are assembled together and then attached to a sewing machine. The sewing machine then embroiders a pattern on the fabric within the border of the hoop. However, this operation has created a number of problems. For example, there is a tendency for such a hoop arrangement to distort the fabric when it is clamped or pinched by the hoops. Puckering of the embroidered fabric also results when a stretchable or delicate material is embroidered in a two-piece hoop and the material and image distort when the tension in the fabric is released. Additionally, the cumbersome nature of the hoop assembly makes it difficult to properly center the portion of the fabric to be embroidered within the hoop.

While the problem of different makes of embroidery machines has not been addressed, attempts have been made to solve the problems associated with the two-piece hoop assembly. For instance, devices have been developed for securing fabric in place relative to a needle of a sewing machine while applying an image to the fabric. Such devices comprise a plate having substantially flat upper and lower surfaces with an embroidery opening formed therethrough. A material backing having an adhesive is attached to the lower surface of the plate, with an adhesive attachment surface accessible through the embroidery opening. The fabric to be embroidered is then applied to the upper surface of the plate, where it is held by the adhesive to the backing accessible through the embroidery opening. Following the embroidery operation, the embroidered fabric is simply pulled away, taking with it that portion of the backing corresponding to the embroidered image. Again, however, while these frames have different configurations for different apparel or embroidered designs, the fabric frame holder and frame are conventionally a unitary device, which causes the maintaining of even more fabric frame holders for the embroiderer. Although successful embroidery operations must be adaptable to the embroidery of numerous types and shapes of fabrics, the costs of purchasing multiple frames for different machines quickly becomes prohibitive.

SUMMARY OF THE INVENTION

The present invention is directed to a fabric holding device that addresses both of the problems described above. The same fabric frame holder can be easily and quickly installed on various makes of automated embroidery machines without the need for modifications to the machine. Further, the fabric frame holder of the present invention is adaptable to receive various sizes and shapes of fabric mounting frames that also can be quickly changed for a particular application and inexpensively purchased as an accessory for the fabric frame holder. While, each fabric frame holder is usable on various makes of machines, while at the same time being capable of holding a variety of shapes and sizes of mounting frames; the adaptability of the frame holder of the present invention to various sizes and shapes of mounting frames provides significant advantages and cost savings even without being interchangeable among the various makes of automated embroidery machines.

Thus, one aspect of the present invention is to provide a fabric frame holder that is interchangeable with different makes of embroidery machines. To accomplish this the attachment arms must be configured differently at the outer ends. One way of accomplishing this is to make the entire attachment arm replaceable. However, preferably, the attachment arms are provided with adaptor plates at the terminal attachment ends thereof. Instead of having the terminal attachment ends of the attachment arms uniquely shaped for mating engagement with a particular model of automated embroidery machine, the terminal attachment ends of the attachment arms are in reality attachment ends having threaded holes formed therethrough. A plurality of sets of adapter plates are provided, each having holes corresponding to threaded holes in the attachment arms. A selected appropriate set of adapter plates corresponds to the machine of a particular manufacturer and is affixed to each terminal attachment end of the attachment arms via the threaded holes therein. The free end of each plate set is configured to mate with the embroidery frame holders of a particular embroidery machine. For example, for a Tajima machine, adapters formed to mate with that machine are removably attached to the ends of the attachment arms. For a Melco machine a different set of adaptors is used. So that a single frame holder may be interchangeably used from one model to another, the adapters may be quickly and easily changed. An embroiderer will have to purchase only one fabric frame holder, even if two or more different models of machines are being used within the same facility.

A second aspect of the present invention is to provide a fabric frame holder that is capable of receiving a variety of interchangeable mounting frames. The central area of the frame holder is adapted for simple attachment and removal of mounting frames. As the mounting frames themselves are, by necessity, relatively thin, provisions are required for rigidly aligning and supporting them. One or more pins or other alignment devices are formed on or applied to the upper surface of the frame holder for proper alignment of a selected frame. A thumbscrew is threadably engaged through the central area of the frame holder to engage with and secure the mounting frame to the holder.

The interchangeable mounting frames of the present invention may be formed in an unlimited number of shapes and sizes, but each share common attachment features. That is, each interchangeable mounting frame includes a hoop portion and an integrally formed mounting portion. The mounting portion is generally rectangular and flat and sized to fit within the area of the central area of the frame holder. The mounting portion desirably has one or more small apertures corresponding in spatial relation to the alignment pins on the frame holder. A centrally-located notch, or slot, is formed through the free end of the mounting portion and is open on the outer edge so that the mounting frame can be simply slid beneath the thumbscrew and aligned over the pins. Once in position, the thumbscrew can be manipulated to exert pressure against the top of the mounting portion, holding it securely in place.

These and other aspects of the present invention will become apparent to those skilled in the art after a reading of the following description of the preferred embodiment when considered with the drawings.

DESCRIPTION OF THE PREFERRED EMBODIMENTS

Figure 2:
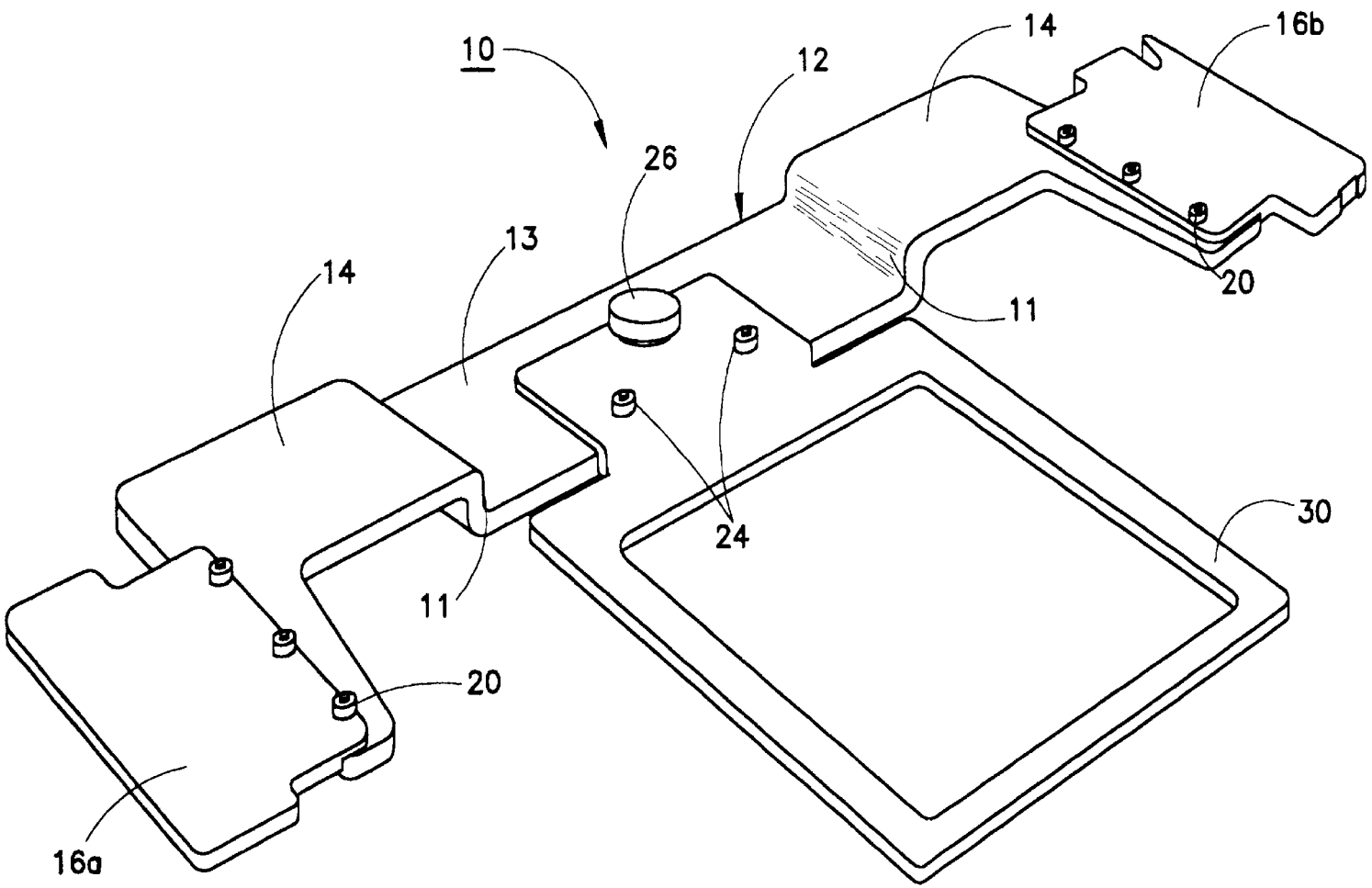
FIG. 2 is a top front perspective view of the embroidery device constructed according to the present invention.
Figure 3:
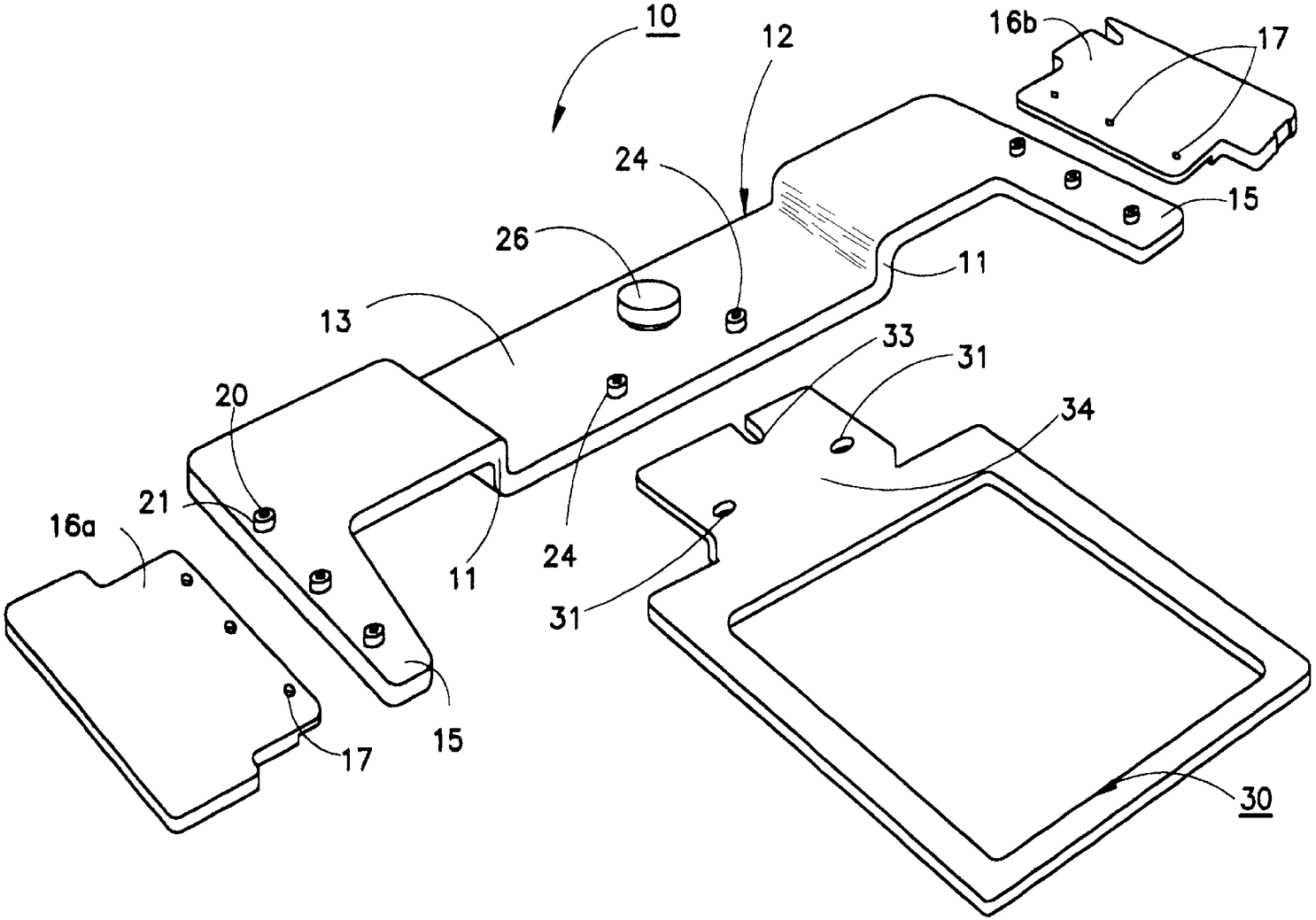
FIG. 3 is an exploded top front perspective view of the embroidery device of FIG. 1.

Referring now to the drawings in general and FIGS. 2 and 3 in particular, it will be understood that the illustrations are for the purpose of describing a preferred embodiment of the invention and are not intended to limit the invention thereto. Shown generally as 10, the interchangeable fabric frame holder includes a body portion 12, with attachment arms 14. Body portion 12 is adaptable to receive interchangeable mounting frames 30.

Figure 1:
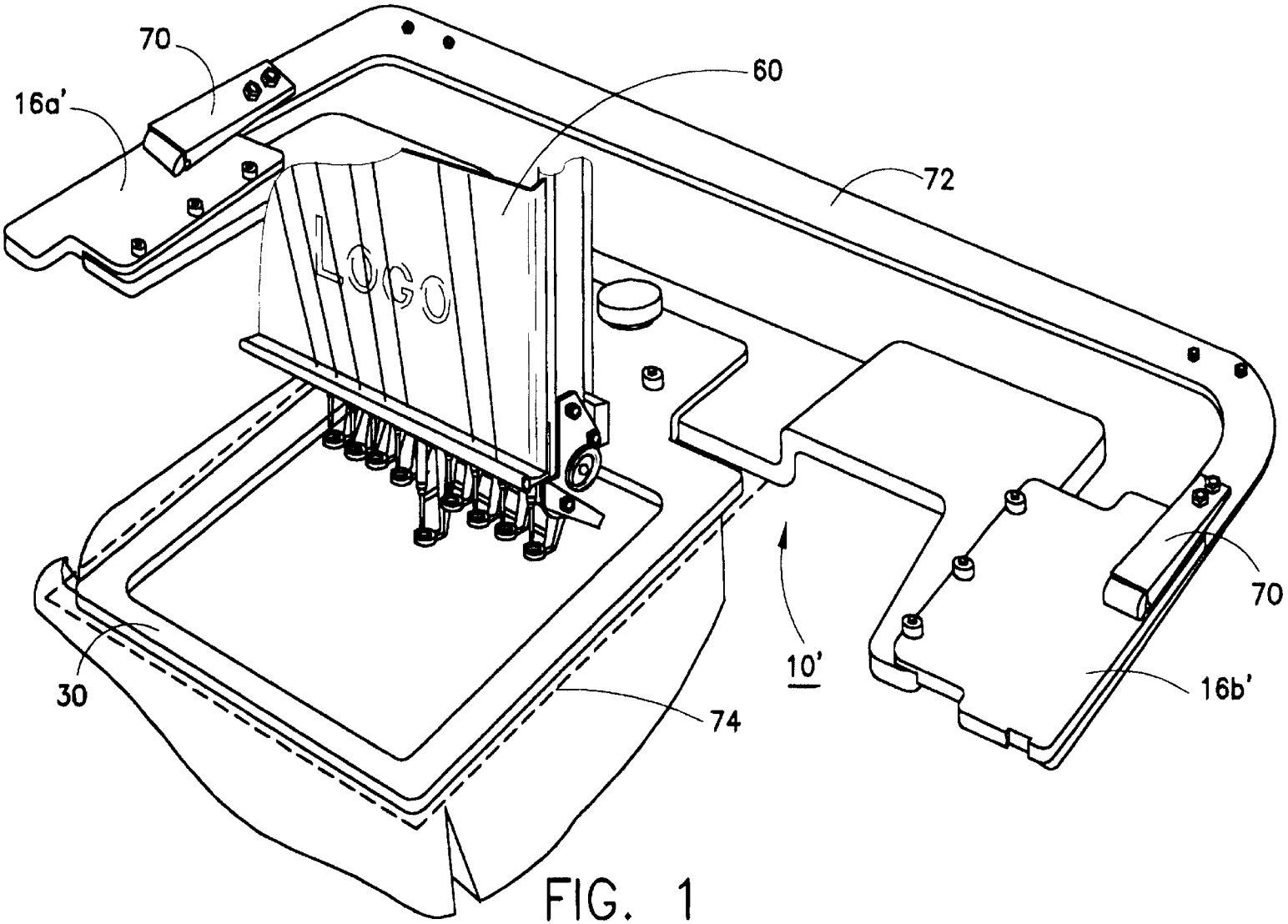
FIG. 1 is an environmental view of the embroidery device of the present invention installed on a typical automated Brother embroidery machine.

FIG. 1 is illustrative of the fabric frame holder of the present invention as installed on a Brother automatic embroidery machine. FIG. 2 is illustrative of the fabric frameholder adaptable to an SWF embroidery machine, and for ease of illustration, FIG. 3 provides an exploded view of fabric frame holder 10. While body portion 12 with attachment arms 14 are seen shown as a singular piece, they may also be formed of multiple attached pieces. In the preferred embodiment, body portion 12 has a central area 13, being substantially flat and rectangular, with sufficient length and width to accommodate the variety of mounting frames 30. Attachment arms 14 are integrally formed with and extend outwardly from central area 13. Attachment arms 14 are also substantially flat, however are separated from the central area 13 so that central area 13 is slightly below the level of arms 14 by a step-up portion 11. This permits the attachment arms 14 to engage the carriage of the particular embroidery machine while positioning the fabric frame holder, and an attached mounting frame 30, in position relative to the platform 74 of the embroidery machine. As those skilled in the art will appreciate, other configurations for the fabric frame holder and attachment arms are equally suitable, such as, for example, having attachment arms that incline upward from the frame holder, terminating with horizontal terminal attachment ends.

One aspect of the present invention is that fabric frame holder 10 can be mounted on any model of automated embroidery machine without the need to move or alter any features or hardware, such as pneumatic hoses, from the embroidery machine. One way to accomplish this is to have the attachment arms 14 removably attachable to the fabric frame holder 10. By using different configurations on the terminal attachment ends 15 of the arms, the attachment arms 14 may be interchanged to fit different models of automated embroidery machines.

In the preferred embodiment of the present invention, sets of adaptor plates 16*a* and 16*b* are mounted on the terminal attachment ends 15 of arms 14 to adapt the fabric frame holder to fit various models of machines. For this adaptable fabric frame holder, the body portion 12 and attachment arms 14 are identical, regardless of the make of the embroidery machine. However, attachment arms 14 are dimensioned to receive the set of adapter plates 16*a* and 16*b*. The adapter plates (shown here for an SWF machine) are selectively chosen to matingly engage with a particular model of embroidery machine. As best seen in FIG. 3, attachment arms 14 each have a series of threaded holes 21 that are formed in their outer ends. Adapter plates 16*a* and 16*b* are easily attached to the terminal attachment ends 15 of attachment arms 14 with threaded fasteners 20 that extend through holes 17 in adaptor plates 16*a* and 16*b* and into corresponding holes 21 in arms 14. When attached together, fabric frame holder 10 is ready to be mounted on the selected embroidery machine. As best seen in FIGS. 5A through 5E, each pair of adaptor plates is specifically shaped to mate with a particular make of embroidery machine. For example, slots and grooves 82, 84, 86, and 88 are formed in adaptor plate 16*a*" (the left adaptor plate when facing the front of the machine), and slots and notches 83, 85, 87, and 89 are formed in adaptor plate 16*b*". The notches, slots, and grooves match the carriage mounting geometries of the particular embroidery machine.

FIGS. 5A through 5E are illustrative, though not exhaustive, of typical sets of adapter pairs that are interchangeably mounted to arms 14' of the present invention. FIGS. 5A through 5E schematically show sets of adapter pairs for the Melco, Barudan, SWF, Tajima, and Brother machines, respectively.

A second aspect of the present invention is that the fabric frame holder 10 be capable of mating engagement with a variety of interchangeable mounting frames 30 so that the mounting frames are firmly held and correctly aligned. To provide this capability, and as best seen in FIGS. 2 and 3, a pair of alignment pins 24 are formed on the upper surface of central area 13 to extend through corresponding holes or slots 31 in a mounting frame, such as the one shown as 30. Pins 24 help align and rigidly secure mounting frame 30 to the central area 13 of fabric frame holder 10. A fastener, such as a thumbscrew 26, engages slot 33 formed in the free end of the mounting frame 30. While a thumbscrew 26 is illustrated, there exist a number of suitable fasteners such as screws, bolts, snaps, clamps, and springs that achieve the same result.

Figure 4D:
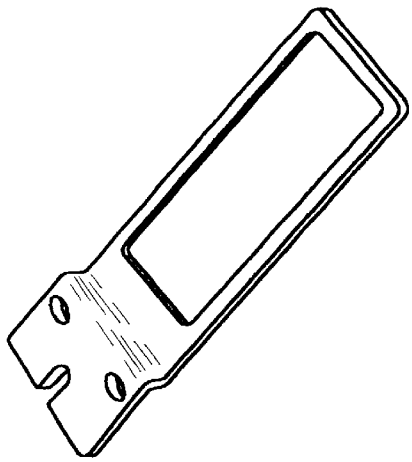
FIG. 4D is a top view of an alternate mounting frame.
Figure 4A:
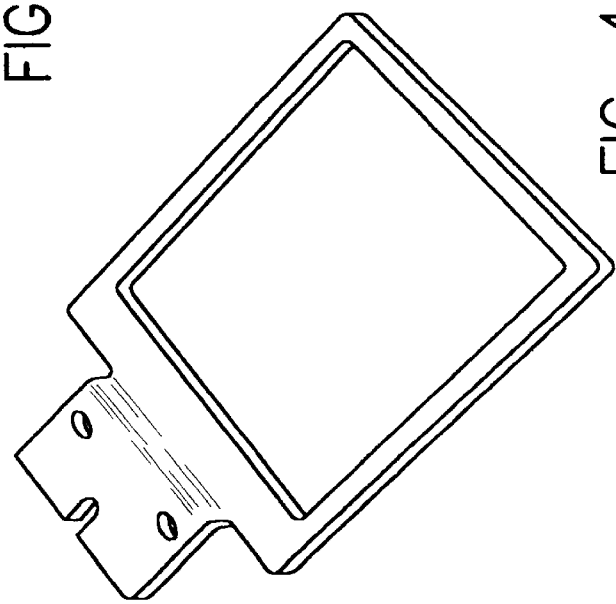
FIG. 4A is a top view of one type of mounting frame.
Figure 4C:
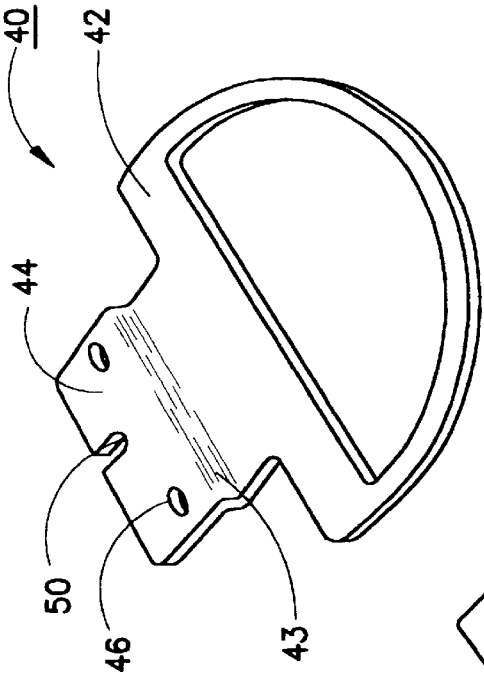
FIG. 4C is a top view of an alternate mounting frame.
Figure 4B:
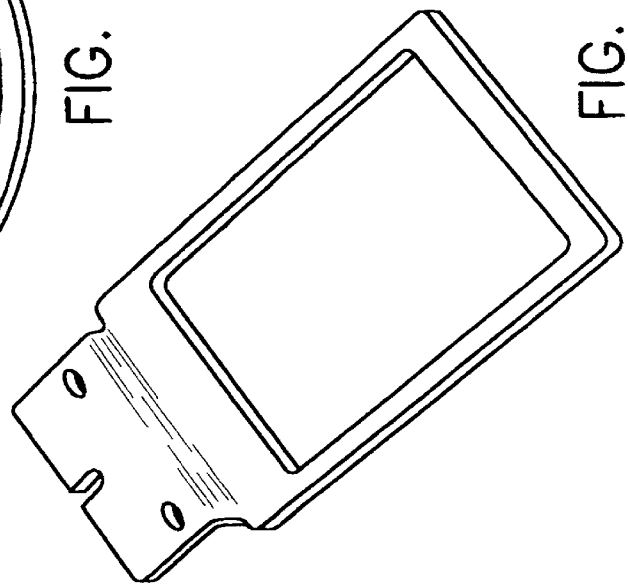
FIG. 4B is a top view of an alternate mounting frame.
Figure 5A:
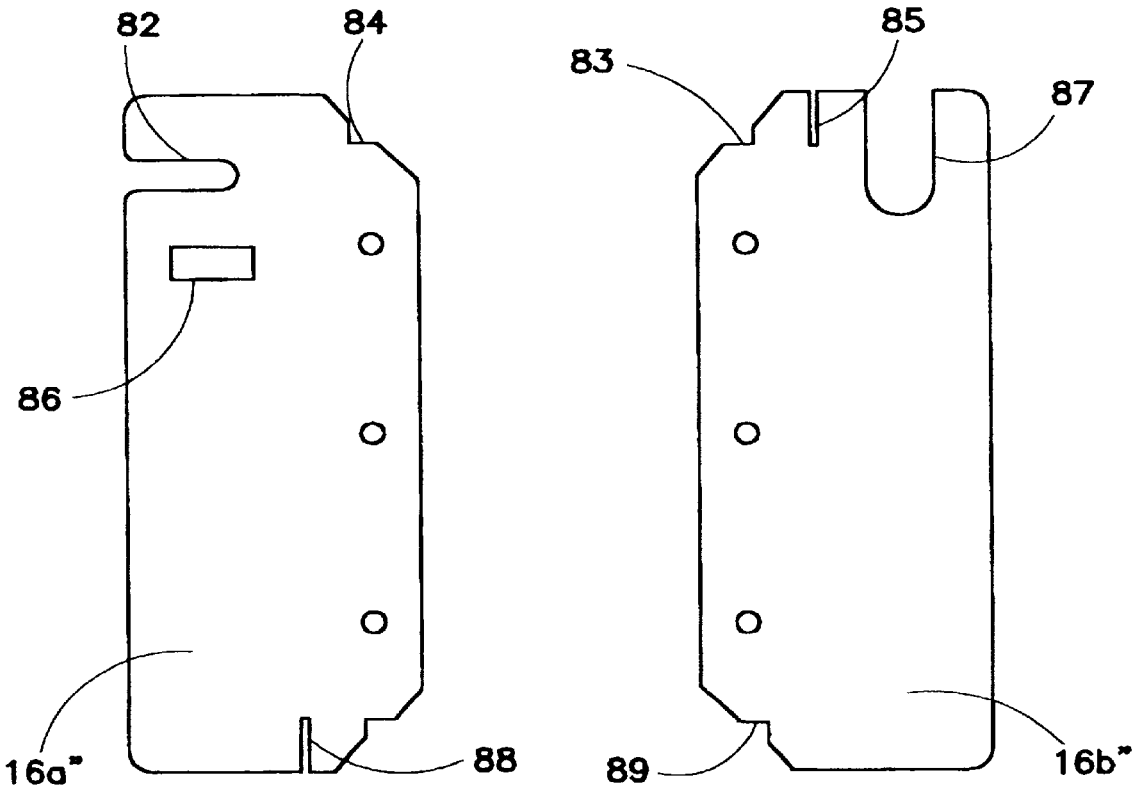
FIG. 5A is a top view of a set of adaptor plates for a Melco embroidery machine.
Figure 5B:
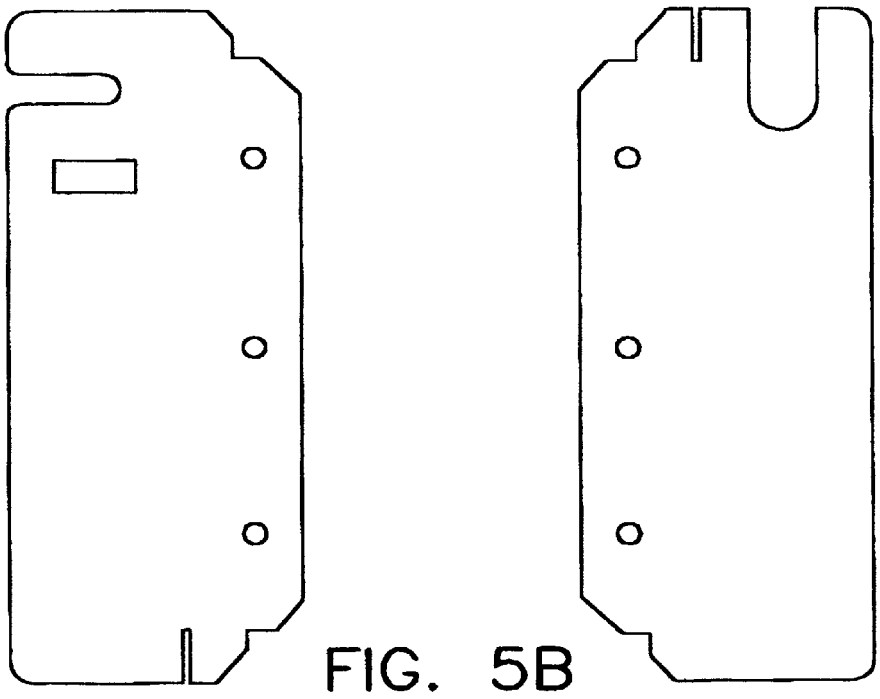
FIG. 5B is a top view of a set of adaptor plates for a Barudan embroidery machine.
Figure 5C:
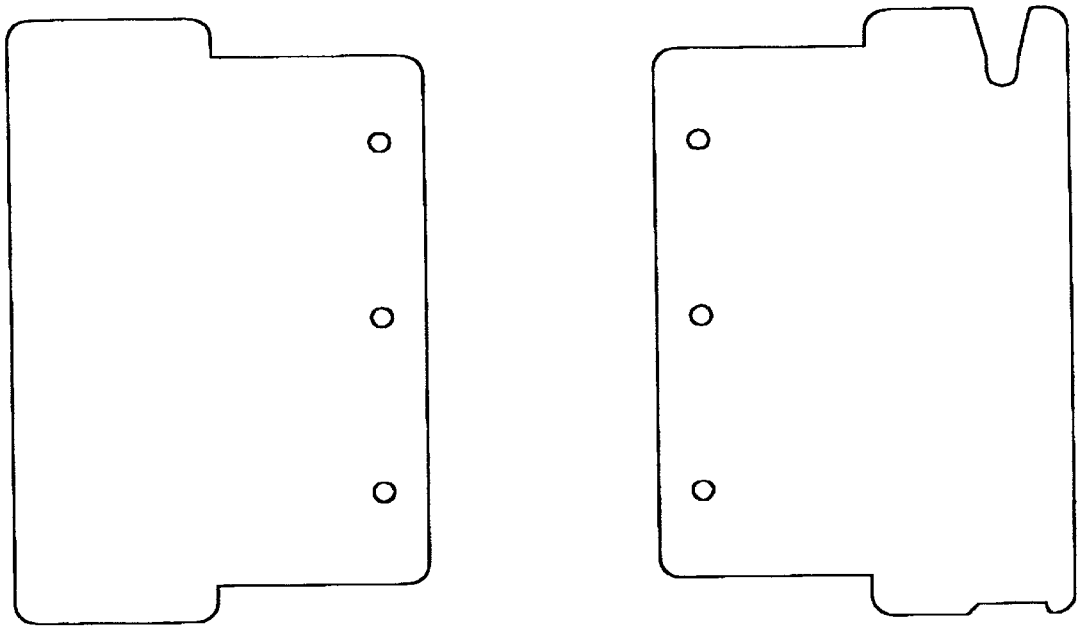
FIG. 5C is a top view of a set of adaptor plates for a SWF embroidery machine.
Figure 5D:
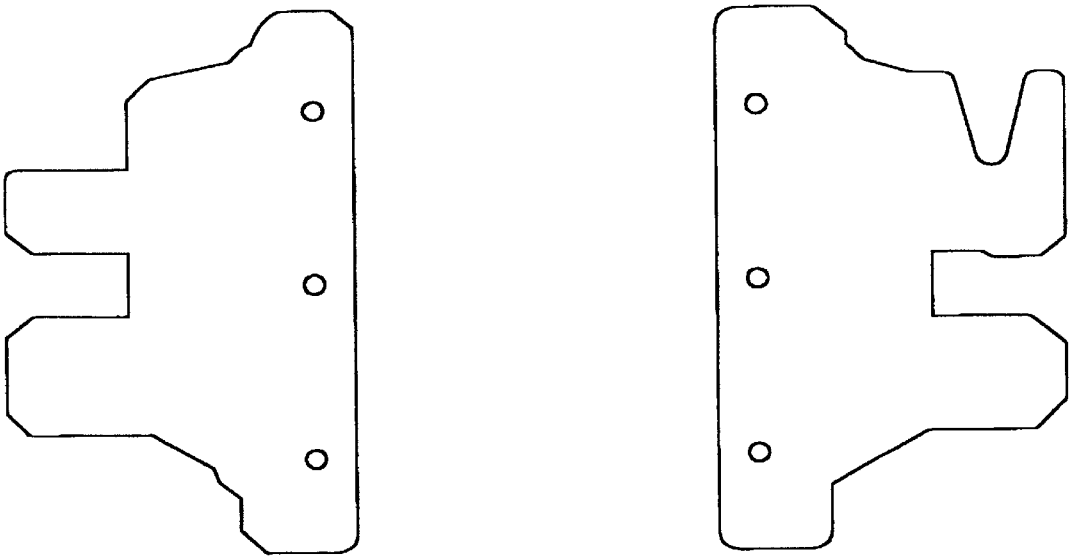
FIG. 5D is a top view of a set of adaptor plates for a Tajima embroidery machine.
Figure 5E:
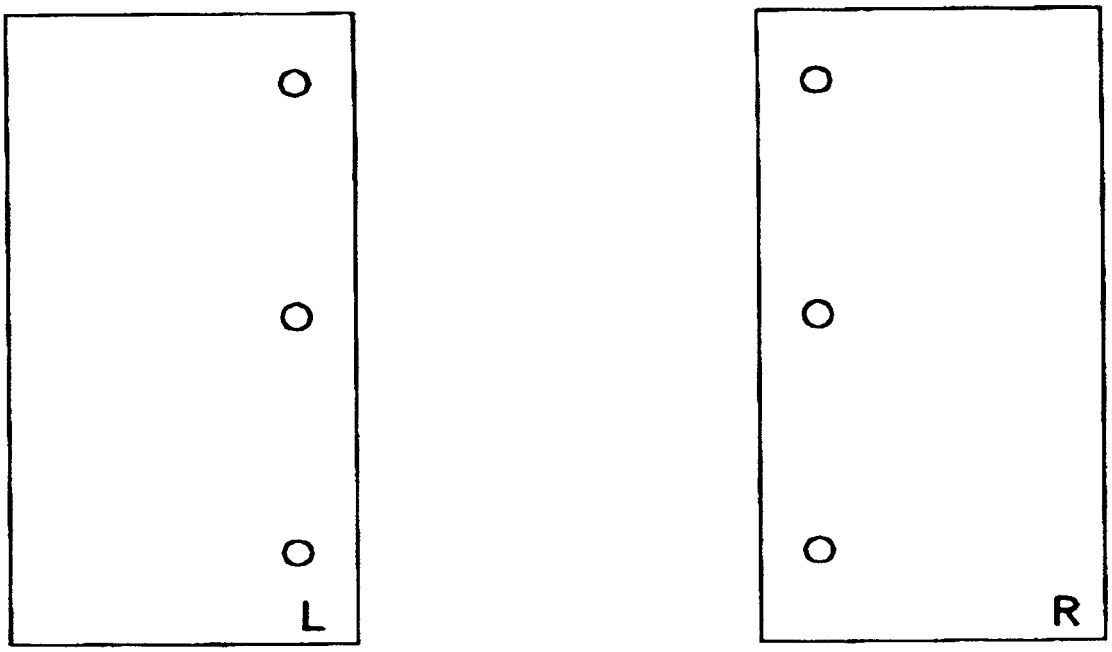
FIG. 5E is a top view of a set of adaptor plates for a Brother embroidery machine.

The interchangeable frames of the present invention can be formed in an unlimited number of shapes and sizes. FIGS. 4A through 4D are illustrative, though not exhaustive, of typical mounting frames that are interchangeably mounted to fabric frame holder 10. The frames shown in FIGS. 4A through 4D are used for only several of the unlimited applications in which embroidery is used. For example, the frame shown in FIG. 4A may be used on larger items of apparel such as childrens' clothing. FIGS. 4B and 4D are illustrative of frames that might be used for the embroidery of pockets or sleeves. FIG. 4C is a shape that is most suitable for embroidering the backs of caps. While they differ in shape and size, the mounting frames shown in FIGS. 4A through 4D each share common features. Referring to FIGS. 4A through 4D, and particularly to FIG. 4A, each of the interchangeable frames includes an embroidery hoop portion 42 and an integrally-formed mounting portion 44. Holes or slots 46 formed through the mounting portion 44 correspond in spatial relation to pins 24 on body portion 12 so that frame 40 is quickly aligned with the central area 13. While not required, frames may be formed with a flanged or curved portion 43 to aid in alignment and stability of the mounting frame. A slot 50 is formed in the free edge of mounting portion 44 so that the frame may be easily slid beneath thumbscrew 26 and aligned with pins 24. Once in position, thumbscrew 26 is rotated in conventional manner to exert force pressure against mounting portion 44, holding the mounting frame 40 securely in place. Similarly, when a different mounting frame is desired for a different application on the same machine, it is not necessary to remove the entire fabric frame holder 10 from the machine. Rather, the user need only loosen the thumbscrew, slidably remove the mounting frame, and install the new mounting frame in the manner describe above.

Referring again to FIG. 1, an illustrative environmental view of the embroidery frame 10' of the present invention is mounted on a Brother machine, illustrating how mounting frame 30 defines an embroidery opening for the embroidery head 60. Adapters 16*a*' and 16*b*' are received by the arms 70 of the mounting carriage 72 of the machine to securely hold fabric frame holder 10' in place during embroidery operations. Arms 70 will, of course, vary in configuration, shape, and form of mating engagement from one model of machine to another, but the distance between the arms that form a station is substantially the same.

Certain modifications and improvements will occur to those skilled in the art upon a reading of the foregoing description. It should be understood that all such modifications and improvements have been deleted herein for the sake of conciseness and readability but are properly within the scope of the following claims.

We claim:

1. A fabric frame holder of the type that attaches to a carriage of an embroidery machine and positions a mounting frame in proper position relative to an embroidery platform, comprising:

(a) a body portion, a plurality of sets of adaptor plates, and a plurality of fabric mounting frames;

(b) the body portion having a central area for releasably receiving the fabric mounting frames, and a pair of attachment arms extending laterally to either side;

(c) the attachment arms terminating in terminal attachment ends to which ends one set of the adaptor plates, which correspond to the type of embroidery machine being utilized, are attached; and (d) a selected one of the fabric mounting frames being releasably mounted to said central body portion.

2. The fabric frame holder of claim 1 further including:

(a) a plurality of pins projecting upwardly from the surface of the central area and a threaded fastener extending downwardly into the central area;

(b) each of said plurality of mounting frames has a mounting portion, said mounting portion having a plurality of holes formed therethrough and a free end with a slot formed therein; and (c) when said mounting frame is positioned for attachment to said central area, the pins on the central area extend upwardly through the holes in the mounting portion and the slot in said free end engages the threaded fastener, wherein when said threaded fastener is tightened downwardly against said mounting portion, said frame is held rigidly in correct alignment with respect to said body portion.

3. The fabric frame holder of claim 1 wherein the central area is substantially flat and each of the attachment arms are raised above the surface of the central area a distance sufficient to allow the arms to engage the carriage and the mounting frame to be positioned properly with respect to the embroidery platform.

4. The fabric frame holder of claim 1 wherein each of the fabric mounting frames are attachable to and releasable from said body portion without detaching the body portion from the embroidery machine.

5. The fabric frame holder of claim 1 wherein each of said adaptor plates comprises:

(a) a first side portion having a plurality of holes formed therethrough, said holes corresponding to holes formed in said terminal attachment end of the attachment arm, wherein said adaptor plate is attached to said terminal attachment end with threaded fasteners extending therethrough the holes in said adaptor plate and in said terminal attachment ends; and (b) a second side portion, said second portion having a pattern formed therein, the pattern specifically adapted for mating engagement with the carriage of the embroidery machine being utilized.

6. A fabric frame holder comprising:

(a) a frame holder with a body portion and a plurality of fabric mounting frames;

(b) the body portion having a central area for releasably receiving the fabric mounting frames, and a pair of attachment arms extending laterally to either side (c) the attachment arms having means for attachment to an embroidery machine; and (d) a selected one of the fabric mounting frames being releasably mounted to said central body portion.

7. The fabric frame holder of claim 6 wherein each of said attachment arms is formed as a unitary member.

8. The fabric frame holder of claim 6 further including:

(a) a plurality of pins projecting upwardly from the surface of the central area and a threaded fastener extending downwardly into the central area;

(b) each of said plurality of mounting frames has a mounting portion, said mounting portion having a plurality of holes formed therethrough and a free end with a slot formed therein; and (c) when said mounting frame is positioned for attachment to said central area, the pins on the central area extend upwardly through the holes in the mounting portion and the slot in said free end engages the threaded fastener, wherein when said threaded fastener is tightened downwardly against said mounting portion, said frame is held rigidly in correct alignment with respect to said body portion.

9. The fabric frame holder of claim 6 wherein the central area is substantially flat and each of the attachment arms are raised above the surface of the central area a distance sufficient to allow the arms to engage the carriage and the mounting frame to be positioned properly with respect to the embroidery platform.

10. The fabric frame holder of claim 6 wherein each of the fabric mounting frames are attachable to and releasable from said body portion without detaching the body portion from the embroidery machine.

11. The fabric frame holder of claim 6 wherein each of said adaptor plates comprises:

(a) a first side portion having a plurality of holes formed therethrough, said holes corresponding to holes formed in said terminal attachment end of the attachment arm, wherein said adaptor plate is attached to said terminal attachment end with threaded fasteners extending therethrough the holes in said adaptor plate and in said terminal attachment ends; and (b) a second side portion, said second portion having a pattern formed therein, the pattern specifically adapted for mating engagement with the carriage of the embroidery machine being utilized.

* * * * *